US011808061B2

(12) United States Patent
Yang

(10) Patent No.: US 11,808,061 B2
(45) Date of Patent: Nov. 7, 2023

(54) ANTI-THEFT LOCK FOR PORTABLE ELECTRONIC DEVICE

(71) Applicant: JIN TAY INDUSTRIES CO., LTD., New Taipei (TW)

(72) Inventor: Kuo-Tsung Yang, Taipei (TW)

(73) Assignee: Jin Tay Industries Co., Ltd., New Taipei (TW)

( * ) Notice: Subject to any disclaimer, the term of this patent is extended or adjusted under 35 U.S.C. 154(b) by 372 days.

(21) Appl. No.: 17/134,956

(22) Filed: Dec. 28, 2020

(65) Prior Publication Data

US 2022/0205283 A1 Jun. 30, 2022

(51) Int. Cl.
*E05B 73/00* (2006.01)

(52) U.S. Cl.
CPC ..... *E05B 73/0082* (2013.01); *E05B 73/0005* (2013.01)

(58) Field of Classification Search
CPC ..... E05B 73/0005; E05B 73/0011; E05B 73/0082
See application file for complete search history.

(56) References Cited

U.S. PATENT DOCUMENTS 5,162,976 A 11/1992 Moore et al.
5,996,383 A 12/1999 Adelmeyer et al.
6,968,716 B1 * 11/2005 Ling ..... E05B 73/0082 70/58
9,187,934 B1 * 11/2015 Lee ..... E05B 73/0017
10,378,249 B1 * 8/2019 Lee ..... E05B 73/0082
10,400,482 B2 * 9/2019 Kao ..... E05B 73/0082
10,718,138 B2 * 7/2020 Wu ..... E05B 73/0082
11,203,886 B2 * 12/2021 Wu ..... E05B 73/0082
11,306,514 B2 * 4/2022 Lin ..... E05B 73/0082
2020/0080346 A1 * 3/2020 Wu ..... E05B 73/0082

FOREIGN PATENT DOCUMENTS

CN 207469954 U 6/2018
CN 210460255 U 5/2020
TW 201636491 A 10/2016

* cited by examiner

*Primary Examiner* — Christopher J Boswell
(74) *Attorney, Agent, or Firm* — Rosenberg, Klein & Lee

(57) ABSTRACT

An anti-theft lock for a portable electronic device has a mounting shaft, two buckling units, a split-abutting unit, and a controlling unit. The two buckling units are moveably mounted around the mounting shaft. The split-abutting unit is moveable and has an engaging end and a split-abutting end. The split-abutting end selectively abuts the two buckling units via the movement of the split-abutting unit. The controlling unit has an annular curved surface. The annular curved surface slidably abuts the engaging end of the split-abutting unit. During the rotation of the controlling unit, the annular curved surface is capable of pushing the split-abutting unit to make the split-abutting end abut the two buckling units with inclined surfaces to move the two buckling units away from each other. The larger a distance the split-abutting unit moves, the larger a distance the two buckling units move away from each other.

15 Claims, 8 Drawing Sheets

ANTI-THEFT LOCK FOR PORTABLE ELECTRONIC DEVICE

BACKGROUND OF THE INVENTION

1. Field of the Invention

The present invention relates to an anti-theft lock, especially to an anti-theft lock for a portable electronic device.

2. Description of the Prior Arts

A portable electronic device is usually installed with an anti-theft locking hole to be interlocked with a specialized anti-theft lock in order to be fixed on a table or in a showcase, so that the portable electronic device will not be stolen on display, and a user is allowed to temporarily leave his/her portable electronic device in public spaces such as a library.

A conventional anti-theft locking hole of a portable electronic device has an opening and a space. The opening is 3*7 mm and is formed on a surface of a case of the portable electronic device. The space is formed in the case, communicates with the opening, and is larger than the opening. With this, buckling units of the specialized anti-theft lock are allowed to be mounted through the opening and be spread in the space to buckle the anti-theft lock in the anti-theft locking hole.

However, with the vigorous development of various brands of portable electronic devices nowadays, the specifications of anti-theft locking holes on each portable electronic device have been diversified, such that a single anti-theft lock will no longer be adaptable for all portable electronic devices. Besides, in order to match the diversified anti-theft locking holes, the anti-theft locks on the market are also diversified such that consumers must make sure whether the anti-theft lock is compatible for their portable electronic devices before purchase, which leads to confusion and inconvenience for the consumers. Further, one user may have multiple portable electronic devices. If the specifications of the anti-theft locking holes of the portable electronic devices are different to each other, the user has to purchase multiple anti-theft locks, which is not only inconvenient to carry, but also increases the cost.

To overcome the shortcomings, the present invention provides an anti-theft lock for a portable electronic device to mitigate or obviate the aforementioned problems.

SUMMARY OF THE INVENTION

The main objective of the present invention is to provide an anti-theft lock for a portable electronic device that is adaptable for anti-theft locking holes of different specifications. Therefore, users will no longer need to worry whether the anti-theft lock is adaptable before purchase, and only need to buy a single anti-theft lock and then can use the anti-theft lock on every portable electronic device they own, thereby saving cost.

The anti-theft lock for portable electronic device has a base, a mounting shaft, two buckling units, a buckling resetting assembly, a split-abutting unit, a controlling unit, a split-abutting resetting unit, and a lock cylinder. The base has an inner space, a mounting groove, and a moving channel. The mounting groove is concaved from a surface of the base toward the inner space. An end of the moving channel communicates with the inner space, and another end of the moving channel communicates with a bottom of the mounting groove. Two ends of the mounting shaft are respectively mounted on two opposite side walls of the mounting groove. Each of the buckling units has an inner end, an outer end, a back surface, a first point, and a second point. The inner end is moveably mounted around the mounting shaft. The outer end is located outside the mounting groove. The back surface is located opposite to the other buckling unit. The first point is formed on the back surface. The second point is formed on the back surface. The second point is closer to the outer end than the first point. A distance between the second points of the two buckling units is larger than a distance between the first points of the two buckling units. The buckling resetting assembly is connected to the two buckling units and is configured to move the two buckling units toward each other. The split-abutting unit moveably is mounted in the moving channel and has an engaging end and a split-abutting end. The engaging end is located in the inner space. The split-abutting end is opposite to the engaging end, is located in the mounting groove, and selectively abuts the two buckling units via the movement of the split-abutting unit. The controlling unit is pivotally mounted in the inner space of the base and has an annular curved surface. The annular curved surface surrounds a rotating axis of the controlling unit and slidably abuts the engaging end of the split-abutting unit. During the rotation of the controlling unit, the annular curved surface is capable of pushing the split-abutting unit toward the outer ends of the two buckling unit to make the split-abutting end of the split-abutting unit abut the two buckling units with inclined surfaces, and to move the two buckling units away from each other by the split-abutting unit pushing the two buckling units. The larger a distance the split-abutting unit moves toward the outer ends of the two buckling units, the larger a distance the two buckling units move away from each other. The annular curved surface has an unlocking point and multiple locking points. When the controlling unit is pivoted to abut the engaging end of the split-abutting unit with the unlocking point, the annular curved surface does not push the split-abutting unit toward the outer ends of the two buckling units. The controlling unit abuts the split-abutting unit by the unlocking point or one of the locking points. Distances for which the annular curved surface pushes the split-abutting unit toward the outer ends of the two buckling units via each of the locking points are different. The split-abutting resetting unit is connected to the split-abutting unit and is configured to make the split-abutting unit abut the annular curved surface of the controlling unit. The lock cylinder is mounted on the base and has a driving shaft extending into the inner space and being capable of driving the controlling unit to pivot.

With the controlling unit pivotally mounted in the inner space of the base and having the annular curved surface surrounding the rotating axis of the controlling unit, and the split-abutting unit moveably mounted in the moving channel of the base, when the controlling unit is turned, the annular curved surface of the controlling unit is capable of pushing the split-abutting unit toward the outer ends of the two buckling units.

Besides, with the two buckling units moveably mounted around the mounting shaft, and with the split-abutting end of the split-abutting unit selectively abutting the two buckling units with inclined surfaces, when the split-abutting unit moves toward the outer ends of the two buckling units, the split-abutting end abuts and pushes the two buckling units to move the two buckling units away from each other through the inclined surfaces.

Additionally, with the multiple locking points on the annular curved surface of the controlling unit, and because the distances for which the annular curved surface pushes the split-abutting unit toward the outer ends of the two buckling units via each of the locking points are different, the controlling unit is capable of abutting the split-abutting unit with one of the locking points to push the split-abutting unit toward the outer ends of the two buckling units for different distances. Further, since the split-abutting end of the split-abutting unit abuts the two buckling units with inclined surfaces, the larger the distance the split-abutting unit moves toward the outer ends of the two buckling units, the larger the distance the two buckling units move away from each other.

Moreover, the annular curved surface further comprises an unlocking point. When the controlling unit abuts the engaging end of the split-abutting unit with the unlocking point, the annular curved surface does not push the split-abutting unit toward the outer ends of the two buckling units, thereby keeping the two buckling units within a minimum distance.

Therefore, a user is allowed to turn the controlling unit via the lock cylinder to control the distance for which the two buckling units move away from each other, in order to adjust the distance between the first points and the distance between the second points on the two buckling units. As a result, the present invention can be applied on and buckle all the anti-theft locking holes of different specifications via the different distances between the second points and the first points.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
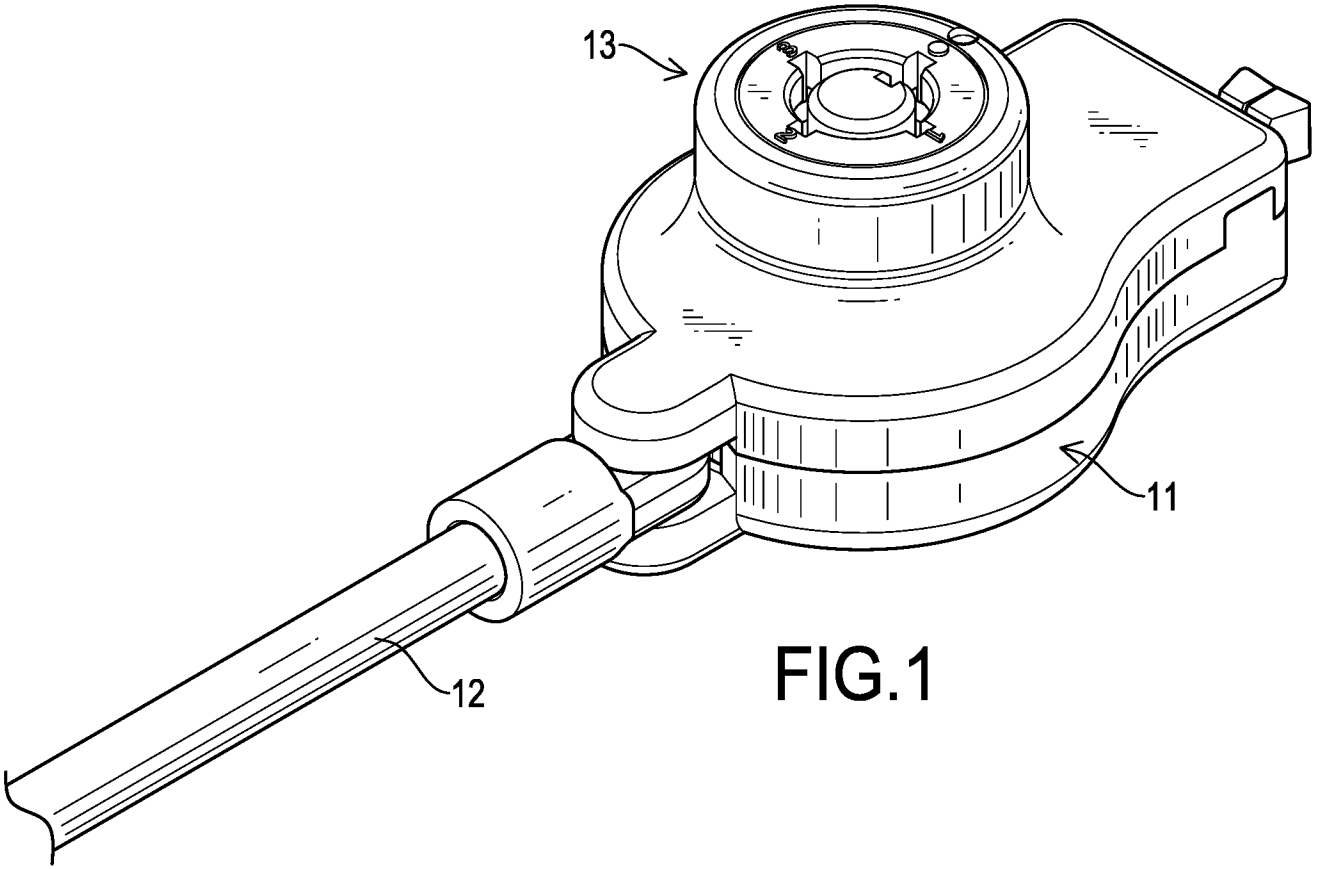
FIG. 1 is a perspective view of an anti-theft lock for a portable electronic device in accordance with the present invention.
Figure 2:
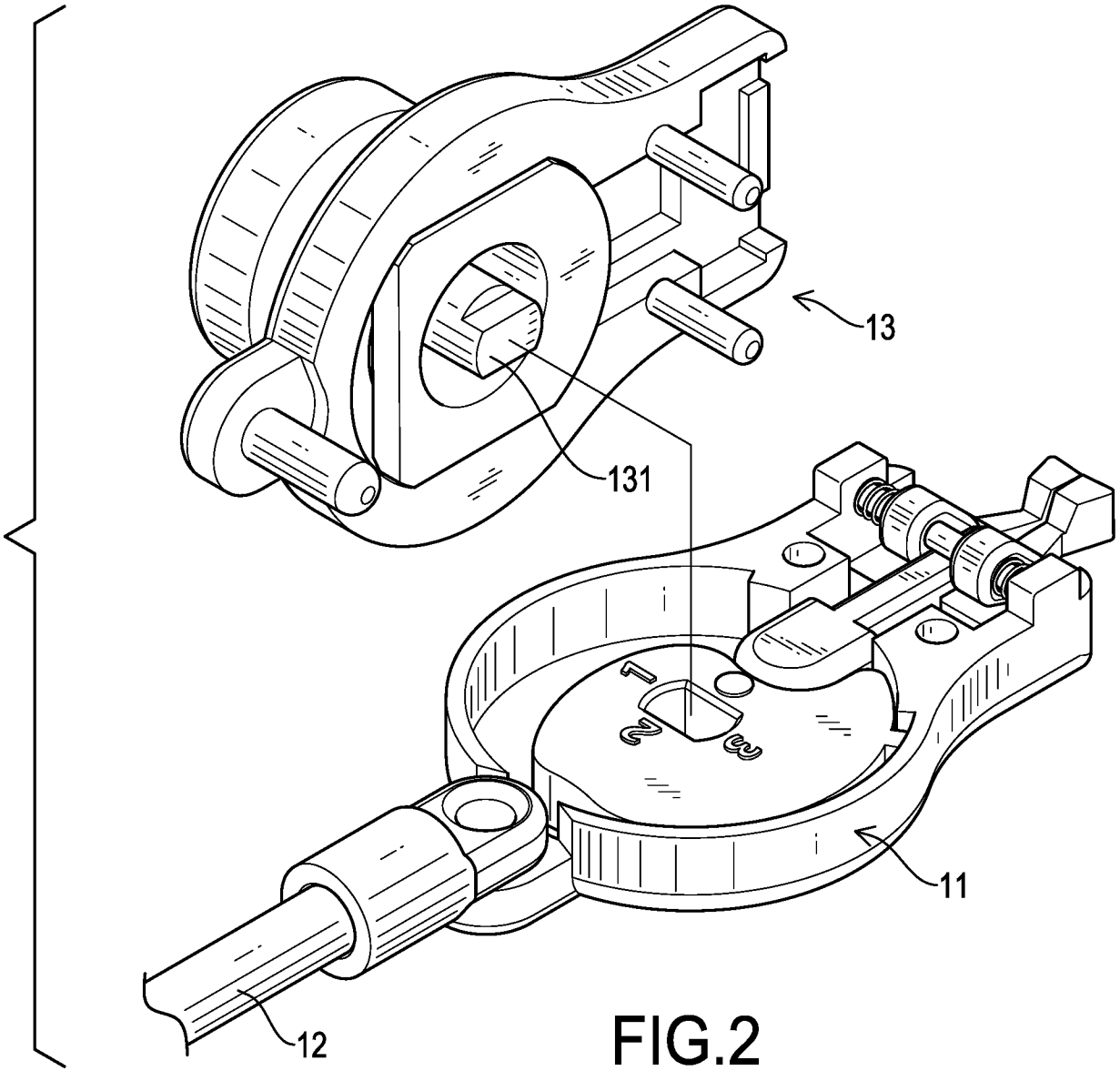
FIG. 2 is an exploded view of the anti-theft lock for a portable electronic device in FIG. 1.
Figure 3:
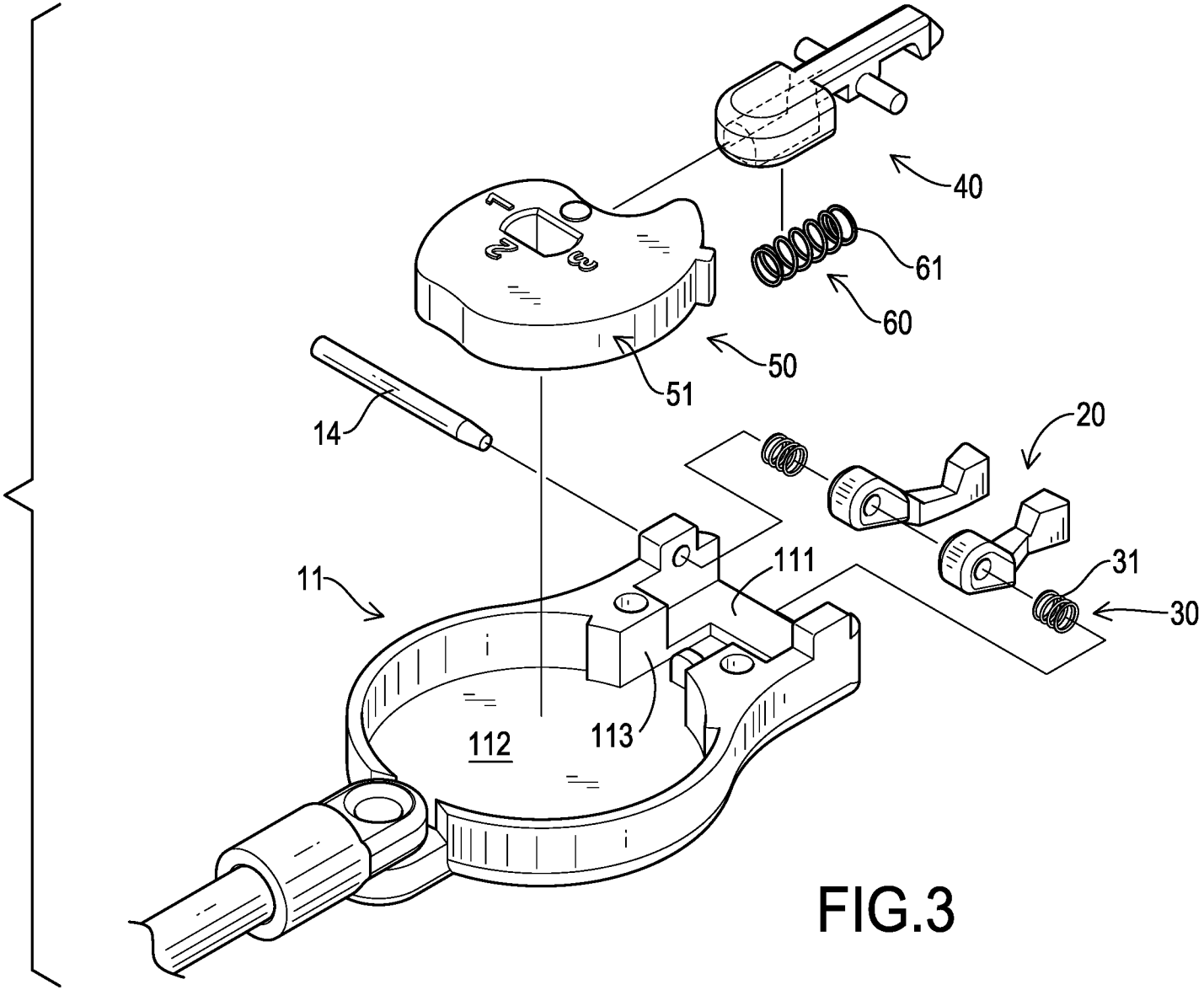
FIG. 3 is another exploded view of the anti-theft lock for a portable electronic device in FIG. 1.

With reference to FIGS. 1, 2, and 3, an anti-theft lock for a portable electronic device in accordance with the present invention comprises a base 11, a rope 12, a lock cylinder 13, a mounting shaft 14, two buckling units 20, a buckling resetting assembly 30, a split-abutting unit 40, a controlling unit 50, and a split-abutting resetting unit 60.

The base 11 has a mounting groove 111, an inner space 112, and a moving channel 113. The mounting groove 111 is concaved from a surface of the base 11 toward the inner space 112. An end of the moving channel 113 communicates with the inner space 112, and another end of the moving channel 113 communicates with a bottom of the mounting groove 111. The rope 12 is mounted on the base 11. The lock cylinder 13 is mounted on the base 11 and has a driving shaft 131. The driving shaft 131 extends into the inner space 112 and is capable of driving the controlling unit 50 to pivot. Two ends of the mounting shaft 14 are respectively mounted on two opposite side walls of the mounting groove 111.

Figure 4:
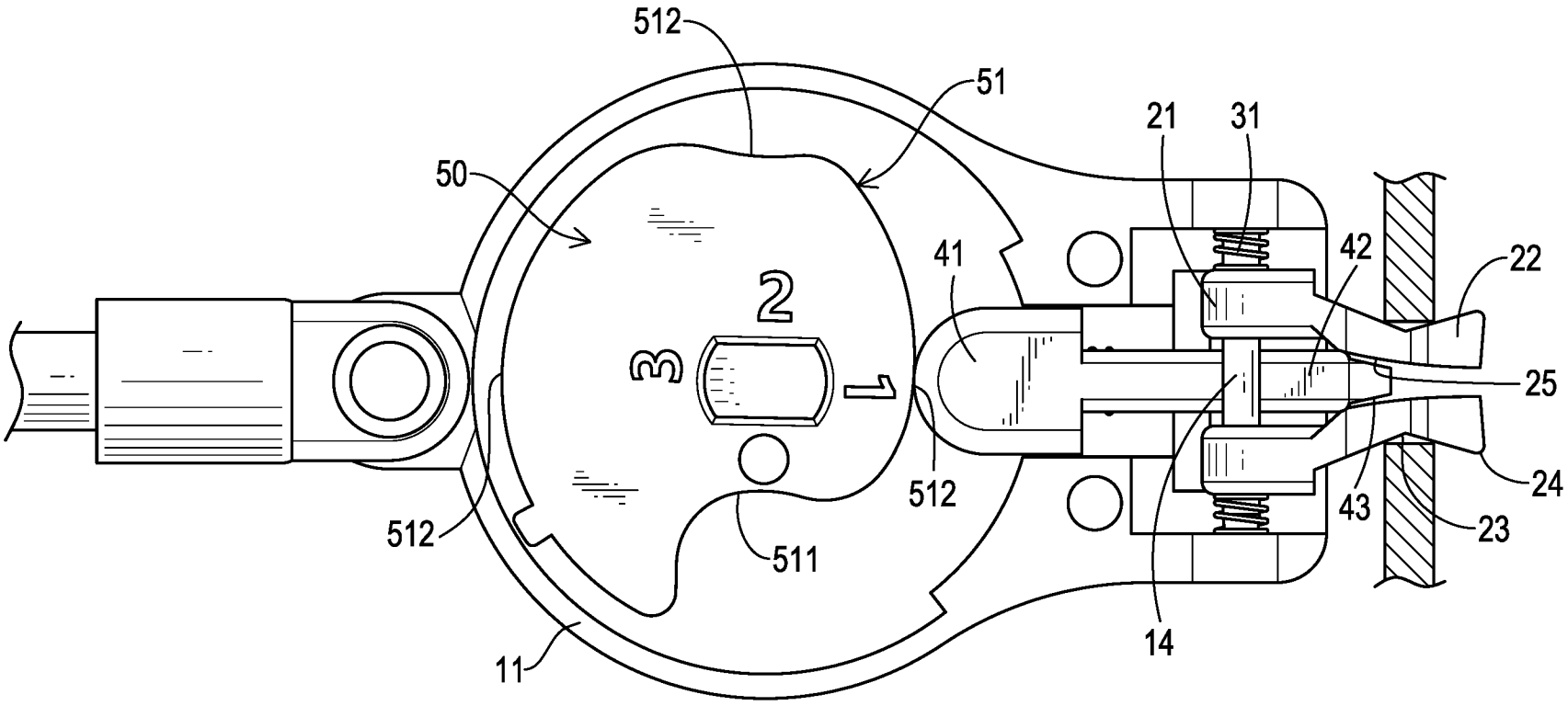
FIGS. 4, 5, and 6 are operational views of the anti-theft lock for a portable electronic device in FIG. 1, showing the controlling unit, the split-abutting unit, and the buckling unit.
Figure 5:
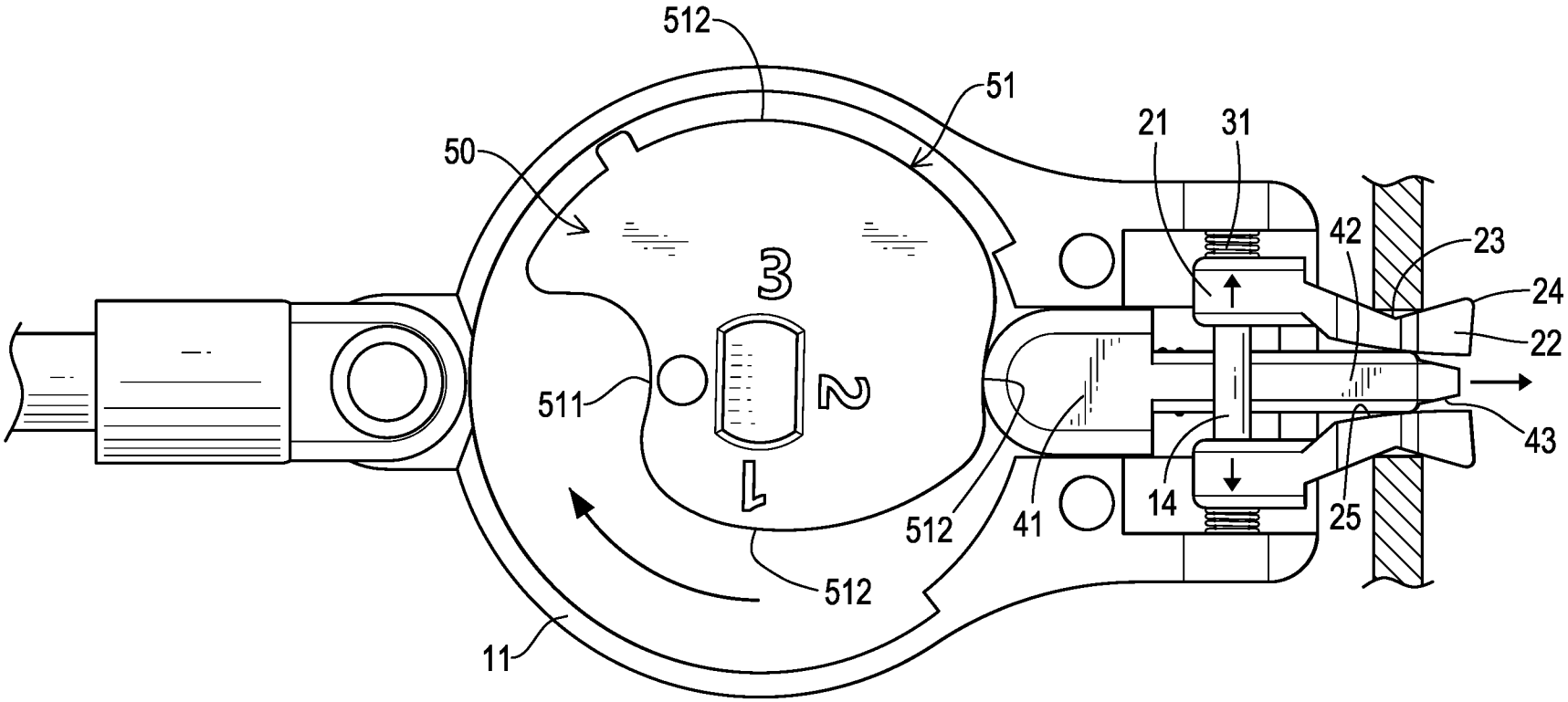
Figure 6:
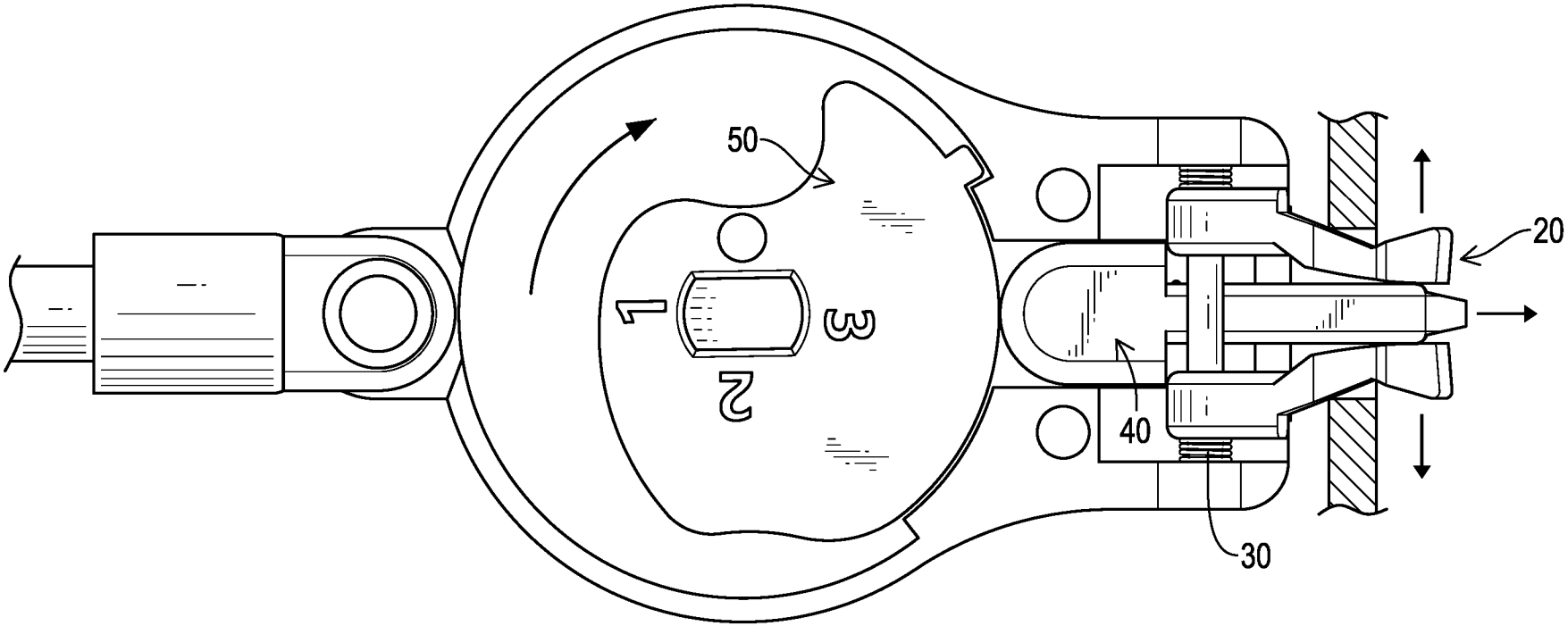

With further reference to FIGS. 4, 5, and 6, each of the buckling units 20 has an inner end 21, an outer end 22, a back surface, a first point 23, and a second point 24. The inner end 21 is moveably mounted around the mounting shaft 14. The outer end 22 is located outside the mounting groove 111. The back surface is located opposite to the other buckling unit 20. The first point 23 is formed on the back surface. The second point 24 is formed on the back surface. In other words, each of the buckling units 20 has the first point 23 and the second point 24 formed on the side surface which is opposite to the other buckling unit 20. The second point 24 is closer to the outer end 22 than the first point 23. A distance between the second points 24 of the two buckling units 20 is larger than a distance between the first points 23 of the two buckling units 20. Therefore, when the two buckling units 20 are mounted through an anti-theft locking hole, the distance between the second points 24 of the two buckling units 20 is wide enough to be stuck inside the anti-theft locking hole, while the distance between the first points 23 of the two buckling units 20 is narrow enough to be mounted through the anti-theft locking hole and to abut an edge of the anti-theft locking hole.

The buckling resetting assembly 30 is connected to the two buckling units 20 and is configured to move the two buckling units 20 toward each other. Specifically, in this embodiment, the buckling resetting assembly 30 has two buckling elastic units 31, and each of the buckling elastic units 31 is a compression spring. The two buckling elastic units 31 are respectively connected to the two buckling units 20 and are respectively connected to the two opposite side walls of the mounting groove 111. Each of the buckling elastic units 31 is located between and abuts the corresponding buckling unit 20 and the corresponding side wall, and the two buckling elastic units 31 are configured to push the two buckling units 20 toward each other. But the configurations of the buckling resetting assembly 30 are not limited to the abovementioned, as the buckling resetting assembly 30 can also be implemented with two magnets respectively mounted on the two buckling units 20.

The split-abutting unit 40 is moveably mounted in the moving channel 113 of the base 11, and has an engaging end 41 and a split-abutting end 42. The engaging end 41 is located in the inner space 112, and in this embodiment, the engaging end 41 has an arced surface. The split-abutting end 42 is opposite to the engaging end 41, is located in the mounting groove 111, and selectively abuts the two buckling units 20 with inclined surfaces via the movement of the split-abutting unit 40.

The controlling unit 50 is pivotally mounted in the inner space 112 of the base 11, and can be driven to pivot by the driving shaft 131 of the lock cylinder 13. The controlling unit 50 has an annular curved surface 51. The annular curved surface 51 surrounds a rotating axis of the controlling unit 50 and slidably abuts the engaging end 41 of the split-abutting unit 40. During the rotation of the controlling unit 50, the annular curved surface 51 is capable of pushing the split-abutting unit 40 toward the outer ends 22 of the two buckling units 20 to make the split-abutting end 42 of the split-abutting unit 40 abut the two buckling units 20 with the inclined surfaces, and to move the two buckling units 20 away from each other by the split-abutting unit 40 pushing the two buckling units 20.

The annular curved surface 51 has an unlocking point 511 and multiple locking points 512. The controlling unit 50 abuts the split-abutting unit 40 with the unlocking point 511 or one of the locking points 512.

The unlocking point 511 selectively abuts the engaging end 41 of the split-abutting unit 40 during the rotation of the controlling unit 50. When the controlling unit 50 is pivoted to abut the engaging end 41 of the split-abutting unit 40 by the unlocking point 511, the annular curved surface 50 does not push the split-abutting unit 40 toward the outer ends 22 of the two buckling units 20.

Each of the locking points 512 selectively abuts the engaging end 41 of the split-abutting unit 40 during the rotation of the controlling unit 50. Distances between the rotating axis of the controlling unit 50 and each of the locking points 512 are different. Thus, when the controlling unit 50 is pivoted to abut the engaging end 41 of the split-abutting unit 40 with any one of the locking points 512, the annular curved surface 51 pushes the split-abutting unit 40 toward the outer ends 22 of the two buckling units 20 for a different distance. In other words, distances for which the annular curved surface 51 pushes the split-abutting unit 40 toward the outer ends 22 of the two buckling units 20 via each of the locking points 512 are different.

Specifically, in this embodiment, the relationship between the two buckling units 20 and the split-abutting unit 40 is as follows. Each of the buckling units 20 has a split-abutting inclined surface 25, and the split-abutting unit 40 has two push-abutting inclined surfaces 43.

The split-abutting inclined surface 25 is formed on a side surface of said buckling unit 20, wherein the side surface faces the other buckling unit 20. The split-abutting inclined surfaces 25 of the two buckling units 20 gradually move toward each other in a direction toward the outer ends 22 of the two buckling units 20. The two push-abutting inclined surfaces 43 are respectively formed on two opposite sides of the split-abutting end 42. The two push-abutting inclined surfaces 43 gradually move toward each other in the direction toward the outer ends 22 of the two buckling units 20.

Therefore, when the split-abutting unit 40 moves toward the outer ends 22 of the two buckling units 20, the split-abutting unit 40 is located and between abuts the split-abutting inclined surfaces 25 of the two buckling units 20 respectively with the two push-abutting inclined surfaces 43, and the two push-abutting inclined surfaces 43 of the split-abutting unit 40 slide relative to the corresponding split-abutting inclined surface 25 of the two buckling units 20 to push the two buckling units 20. Since the split-abutting inclined surfaces 25 of the two buckling units 20 gradually move toward each other in a direction toward the outer ends 22, and the two push-abutting inclined surfaces 43 gradually move toward each other in the direction toward the outer ends 22, the larger a distance the split-abutting unit 40 moves toward the outer ends 22 of the two buckling units 20, the larger a distance the two buckling units 20 move away from each other.

But in other embodiments, the anti-theft lock can also be implemented with only the split-abutting inclined surface 25, or only the push-abutting inclined surface 43, to achieve the same effect, i.e., the larger the distance the split-abutting unit 40 moves toward the outer ends 22 of the two buckling units 20, the larger the distance the two buckling units 20 move away from each other.

The split-abutting resetting unit 60 is connected to the split-abutting unit 40 and is configured to make the split-abutting unit 40 abut the annular curved surface 51 of the controlling unit 50. Specifically, in this embodiment, the split-abutting resetting unit 60 has a split-abutting elastic unit 61, and the split-abutting elastic unit 61 is a compression spring. The split-abutting elastic unit 61 is located between and abuts the split-abutting unit 40 and the base 11, and is configured to push the split-abutting unit 40 toward the controlling unit 50. But in another embodiment, the split-abutting resetting unit 60 can also be implemented with an extension spring or a magnet.

Figure 7:
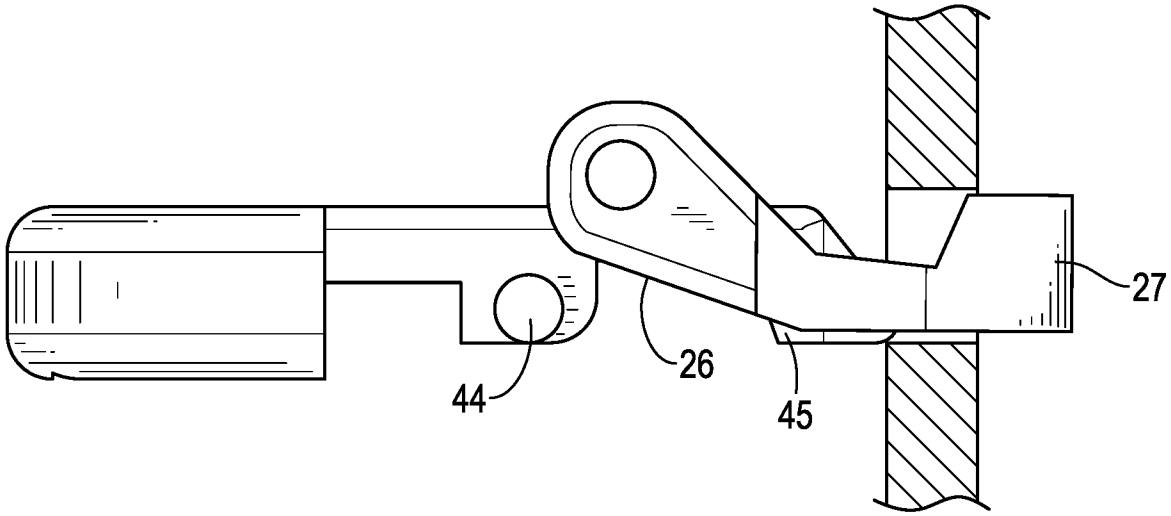
FIGS. 7 and 8 are another operational views of the anti-theft lock for a portable electronic device in FIG. 1, showing the split-abutting unit pushing the buckling unit to pivot.
Figure 8:
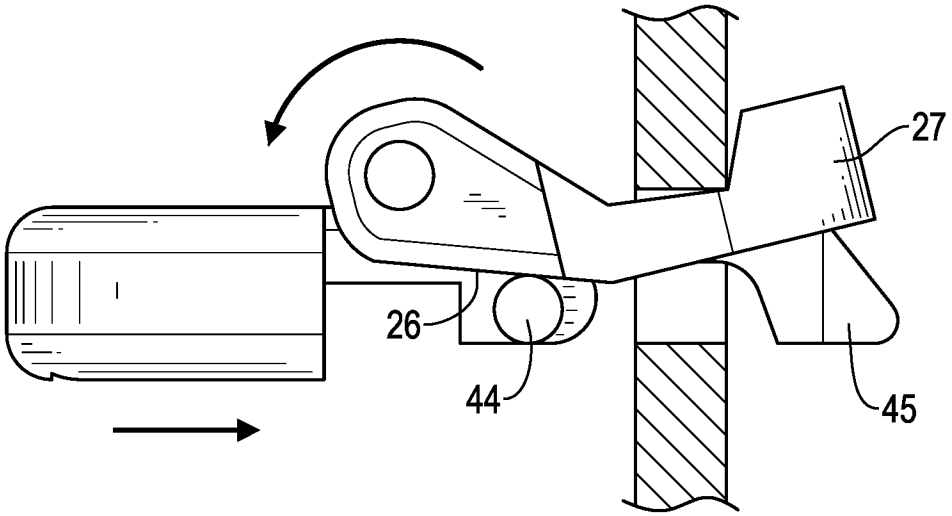

In addition, with further reference to FIGS. 7 and 8, in this embodiment, in addition to the configuration that the two buckling units 20 are split left and right for locking, the anti-theft lock further has another locking function, which is the split-abutting unit 40 and the two buckling units 20 spread up and down to lock, and the structure to achieve such function is as follows.

Each of the buckling units 20 is pivotally mounted around the mounting shaft 14 and has a pivot-abutting inclined surface 26 and a first buckling segment 27. The first buckling segment 27 is formed on the outer end 22 of the buckling unit 20 and extends toward a direction away from the pivot-abutting inclined surface 26.

The split-abutting unit 40 has two pivot-pushing segments 44 and a second buckling segment 45. The second buckling segment 45 is formed on the split-abutting end 42 and extends toward a direction opposite to the direction in which the first buckling segment 27 extends. When the split-abutting unit 40 moves toward the outer ends 22 of the two buckling units 20, the two pivot-pushing segments 44 are capable of respectively abutting the pivot-abutting inclined surfaces 26 of the two buckling units 20, and sliding relative to the pivot-abutting inclined surfaces 26 to push the two buckling units 20 to pivot with the mounting shaft 14 as an rotating axis. When the split-abutting unit 40 moves to the second buckling segment 45 protruding out of the mounting groove 111, the two pivot-pushing segments 44 respectively push the pivot-abutting inclined surfaces 26 of the two buckling units 20.

In other words, when the split-abutting unit 40 moves toward the outer ends 22 of the two buckling units 20, the split-abutting unit 40 can not only push the two buckling units 20 to split the two buckling units 20 left and right, but also push the pivot-abutting inclined surfaces 26 of the two buckling units 20 respectively with the two pivot-pushing segments 44 to pivot the two buckling units 20 upward with the mounting shaft 14 as a rotating axle. As the two buckling units 20 pivot upward, the two buckling units 20 and the split-abutting unit 40 are spread up and down, and therefore the first buckling segment 27 and the second buckling segment 45, which extend away from each other, are capable of buckling the periphery of the opening of the anti-theft locking hole respectively upward and downward.

With the controlling unit 50 pivotally mounted in the inner space 112 of the base 1 land having the annular curved surface 51 surrounding the rotating axis of the controlling unit 50, and the split-abutting unit 40 moveably mounted in the moving channel 113 of the base 11, when the controlling unit 50 is turned, the annular curved surface 51 of the controlling unit 50 is capable of pushing the split-abutting unit 40 toward the outer ends 22 of the two buckling units 20.

Besides, with the two buckling units 20 moveably mounted around the mounting shaft 14, and with the split-abutting end 42 of the split-abutting unit 40 selectively abutting the two buckling units 20 with inclined surfaces, when the split-abutting unit 40 moves toward the outer ends 22 of the two buckling units 20, the split-abutting end 42 abuts and pushes the two buckling units 20 to move the two buckling units 20 away from each other through the inclined surfaces.

Additionally, with the multiple locking points 512 on the annular curved surface 51 of the controlling unit 50, and because the distances for which the annular curved surface 51 pushes the split-abutting unit 40 toward the outer ends 22 of the two buckling units 20 via each of the locking points 512 are different, the controlling unit 50 is capable of abutting the split-abutting unit 40 with one of the locking points 512 to push the split-abutting unit 40 toward the outer ends 22 of the two buckling units 20 for different distances. Further, since the split-abutting end 42 of the split-abutting unit 40 abuts the two buckling units 20 with inclined surfaces, the larger the distance the split-abutting unit 40 moves toward the outer ends 22 of the two buckling units 20, the larger the distance the two buckling units 20 move away from each other.

Moreover, the annular curved surface 51 further comprises the unlocking point 511. When the controlling unit 50 abuts the engaging end 41 of the split-abutting unit 40 with the unlocking point 511, the annular curved surface 51 does not push the split-abutting unit 40 toward the outer ends 22 of the two buckling units 20, thereby keeping the two buckling units 20 within a minimum distance.

Therefore, a user is allowed to turn the controlling unit 50 via the lock cylinder 13 to control the distance for which the two buckling units 20 move away from each other, in order to adjust the distance between the first points 23 and the distance between the second points 24 on the two buckling units 20. As a result, the present invention can be applied on and buckle all the anti-theft locking holes with different specifications through the different distances between the second points 24 and the first points 23.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An anti-theft lock for a portable electronic device comprising:

a base having an inner space;

a mounting groove concaved from a surface of the base toward the inner space; and a moving channel; an end of the moving channel communicating with the inner space, and another end of the moving channel communicating with a bottom of the mounting groove;

a mounting shaft; two ends of the mounting shaft respectively mounted on two opposite side walls of the mounting groove;

two buckling units; the buckling units and the mounting shaft being individual to each other; each of the buckling units having an inner end moveably mounted around the mounting shaft;

an outer end located outside the mounting groove;

a back surface located opposite to the other buckling unit;

a first point formed on the back surface; and a second point formed on the back surface; the second point being closer to the outer end than the first point; a distance between the second points of the two buckling units being larger than a distance between the first points of the two buckling units;

a buckling resetting assembly connected to the two buckling units and configured to move the two buckling units toward each other;

a split-abutting unit moveably mounted in the moving channel and having an engaging end located in the inner space; and a split-abutting end being opposite to the engaging end, located in the mounting groove, and selectively abutting the two buckling units via the movement of the split-abutting unit;

a controlling unit pivotally mounted in the inner space of the base and having an annular curved surface surrounding a rotating axis of the controlling unit and slidably abutting the engaging end of the split-abutting unit; during the rotation of the controlling unit, the annular curved surface being capable of pushing the split-abutting unit toward the outer ends of the two buckling units to make the split-abutting end of the split-abutting unit abut the two buckling units with inclined surfaces, and to move the two buckling units away from each other on the mounting shaft by the split-abutting unit pushing the two buckling units; wherein the larger a distance the split-abutting unit moves toward the outer ends of the two buckling units, the larger a distance the two buckling units move away from each other; the annular curved surface having an unlocking point; wherein when the controlling unit is pivoted to abut the engaging end of the split-abutting unit with the unlocking point, the annular curved surface does not push the split-abutting unit toward the outer ends of the two buckling units; and multiple locking points; the controlling unit abutting the split-abutting unit by the unlocking point or one of the locking points; wherein distances for which the annular curved surface pushes the split-abutting unit toward the outer ends of the two buckling units via each of the locking points are different;

a split-abutting resetting unit connected to the split-abutting unit and configured to make the split-abutting unit abut the annular curved surface of the controlling unit; and a lock cylinder mounted on the base and having a driving shaft extending into the inner space and being capable of driving the controlling unit to pivot;

wherein each of the two buckling units is pivotally mounted around the mounting shaft and has a pivot-abutting inclined surface; and the split-abutting unit has two pivot-pushing segments; wherein when the split-abutting unit moves toward the outer ends of the two buckling units, the two pivot-pushing segments are capable of respectively abutting the pivot-abutting inclined surfaces of the two buckling units and sliding relative to the pivot-abutting inclined surfaces to push the two buckling units to pivot with the mounting shaft as a rotating axis.

2. The anti-theft lock for a portable electronic device as claimed in claim 1, wherein each of the buckling units further has a first buckling segment formed on the outer end and extending toward a direction away from the pivot-abutting inclined surface.

3. The anti-theft lock for a portable electronic device as claimed in claim 2, wherein the split-abutting unit further has a second buckling segment formed on the split-abutting end and extending toward a direction opposite to the direction in which the first buckling segment extends; wherein when the split-abutting unit moves to the second buckling segment protruding out of the mounting groove, the two pivot-pushing segments respectively push the pivot-abutting inclined surfaces of the two buckling units.

4. The anti-theft lock for a portable electronic device as claimed in claim 3, wherein each of the two buckling units has a split-abutting inclined surface formed on a side surface of said buckling unit, wherein the side surface faces the other buckling unit; when the split-abutting unit moves toward the outer ends of the two buckling units, the split-abutting unit is located between and abuts the split-abutting inclined surfaces of the two buckling units and slides relative to the split-abutting inclined surfaces of the two buckling units to push the two buckling units; the split-abutting inclined surfaces of the two buckling units gradually moving toward each other in a direction toward the outer ends of the two buckling units, such that the larger the distance the split-abutting unit moves toward the outer ends of the two buckling units, the larger the distance the two buckling units move away from each other.

5. The anti-theft lock for a portable electronic device as claimed in claim 4, wherein the split-abutting unit has two push-abutting inclined surfaces respectively formed on two opposite sides of the split-abutting end; wherein when the split-abutting unit moves toward the outer ends of the two buckling units, the split-abutting unit abuts the split-abutting inclined surfaces of the two buckling units respectively with the two push-abutting inclined surfaces and slides relative to the split-abutting inclined surfaces of the two buckling units to push the two buckling units; the two push-abutting inclined surfaces gradually move toward each other in the direction toward the outer ends of the two buckling units, such that the larger the distance the split-abutting unit moves toward the outer ends of the two buckling units, the larger the distance the two buckling units move away from each other.

6. The anti-theft lock for a portable electronic device as claimed in claim 5, wherein the buckling resetting assembly has two buckling elastic units respectively connected to the two buckling units and respectively connected to the two opposite side walls of the mounting groove; each of the buckling elastic units located between and abutting the corresponding buckling unit and the corresponding side wall; the two buckling elastic units configured to push the two buckling units toward each other.

7. The anti-theft lock for a portable electronic device as claimed in claim 6, wherein the split-abutting resetting unit a split-abutting elastic unit located between and abutting the split-abutting unit and the base, and configured to push the split-abutting unit toward the controlling unit.

8. The anti-theft lock for a portable electronic device as claimed in claim 7, wherein the anti-theft lock further has a rope mounted on the base.

9. The anti-theft lock for a portable electronic device as claimed in claim 8, wherein the engaging end of the split-abutting unit has an arced surface.

10. The anti-theft lock for a portable electronic device as claimed in claim 1, wherein each of the two buckling units has a split-abutting inclined surface formed on a side surface of said buckling unit, wherein the side surface faces the other buckling unit; when the split-abutting unit moves toward the outer ends of the two buckling units, the split-abutting unit is located between and abuts the split-abutting inclined surfaces of the two buckling units and slides relative to the split-abutting inclined surfaces of the two buckling units to push the two buckling units; the split-abutting inclined surfaces of the two buckling units gradually moving toward each other in a direction toward the outer ends of the two buckling units, such that the larger the distance the split-abutting unit moves toward the outer ends of the two buckling units, the larger the distance the two buckling units move away from each other.

11. The anti-theft lock for a portable electronic device as claimed in claim 1, wherein the split-abutting unit has two push-abutting inclined surfaces respectively formed on two opposite sides of the split-abutting end; wherein when the split-abutting unit moves toward the outer ends of the two buckling units, the split-abutting unit abuts the two buckling units respectively with the two push-abutting inclined surfaces and slides relative to the two buckling units to push the two buckling units; the two push-abutting inclined surfaces gradually move toward each other in a direction toward the outer ends of the two buckling units, such that the larger the distance the split-abutting unit moves toward the outer ends of the two buckling units, the larger the distance the two buckling units move away from each other.

12. The anti-theft lock for a portable electronic device as claimed in claim 1, wherein the buckling resetting assembly has two buckling elastic units respectively connected to the two buckling units and respectively connected to the two opposite side walls of the mounting groove; each of the buckling elastic units located between and abutting the corresponding buckling unit and the corresponding side wall; the two buckling elastic units configured to push the two buckling units toward each other.

13. The anti-theft lock for a portable electronic device as claimed in claim 1, wherein the split-abutting resetting unit a split-abutting elastic unit abutting between the split-abutting unit and the base, and configured to push the split-abutting unit toward the controlling unit.

14. The anti-theft lock for a portable electronic device as claimed in claim 1, wherein the anti-theft lock further has a rope mounted on the base.

15. The anti-theft lock for a portable electronic device as claimed in claim 1, wherein the engaging end of the split-abutting unit has an arced surface.

* * * * *